US007000989B2

(12) United States Patent
Fisher

(10) Patent No.: US 7,000,989 B2
(45) Date of Patent: Feb. 21, 2006

(54) CHAIR OR SEAT

(75) Inventor: Adam William Fisher, Wantirna South (AU)

(73) Assignee: Camatic Pty. Limited, Victoria (AU)

( * ) Notice: Subject to any disclaimer, the term of this patent is extended or adjusted under 35 U.S.C. 154(b) by 79 days.

(21) Appl. No.: 10/615,521

(22) Filed: Jul. 8, 2003

(65) Prior Publication Data

US 2004/0084943 A1 May 6, 2004

(30) Foreign Application Priority Data

Jul. 8, 2002 (AU) ..... 2002950041

(51) Int. Cl.
*A47C 1/121* (2006.01)

(52) U.S. Cl. ..... 297/335; 297/332

(58) Field of Classification Search ..... 297/331, 297/332, 333, 335; 403/119, 146
See application file for complete search history.

(56) References Cited

U.S. PATENT DOCUMENTS

| | | | | | |
|---|---|---|---|---|---|
| 278,691 | A | * | 6/1883 | Durant | 403/146 |
| 424,713 | A | * | 4/1890 | Johnson | 297/335 |
| 562,901 | A | * | 6/1896 | Lambert | 297/335 |
| 1,973,178 | A | * | 9/1934 | Sass | 297/333 |
| 2,000,172 | A | * | 5/1935 | Hanson | 297/249 |
| 2,913,039 | A | * | 11/1959 | Mauser | 297/249 |
| 3,077,364 | A | * | 2/1963 | Eppink | 297/248 |
| 3,727,975 | A | * | 4/1973 | Anderson | 297/332 |
| 3,889,999 | A | * | 6/1975 | Mackintosh | 297/248 |
| 5,328,238 | A | * | 7/1994 | Yamazaki | 297/332 |
| 5,375,914 | A | * | 12/1994 | Donnelly | 297/335 |
| 6,293,621 | B1 | | 9/2001 | Marsh et al. | |
| 6,612,652 | B1 | * | 9/2003 | Tenenboym et al. | 297/354.1 |

FOREIGN PATENT DOCUMENTS

DE 9107315 U1 8/1991

* cited by examiner

*Primary Examiner*—Peter R. Brown
(74) *Attorney, Agent, or Firm*—Gardner Carton & Douglas LLP

(57) ABSTRACT

A chair or seat, for use in theaters and/or stadiums, having a back member, a seat member, an armrest construction, a pivot assembly comprising an aperture on an arm or frame of the chair, a pivot member associated with a chair seat, and a bearing member which can act as a bearing for the rotation and a buffer at the extremes of the rotation whilst ultimately retaining the pivot assembly together, and a counterbalance to enable rotation about a pivot point, whereby the rotational movement is controlled.

The chairs are made from a moulded plastics material with core recesses to impart substantial rigidity to the chair, and can readily be connected to a surface such as a beam, a riser or a tread via a connection means which is connected to the back of the chair.

24 Claims, 7 Drawing Sheets

CHAIR OR SEAT

TECHNICAL AREA

This invention relates to the area of theatre and stadium seating and in particular, to a chair or seat which is adapted for use in theatres and/or stadiums, and is equally applicable to other forms of seats which have their seat and/or back formed of an injection moulded plastics material.

While the invention relates to both chairs and seats, for convenience sake in this specification, the complete article will be referred to herein as a chair, with the word "seat" being reserved to describe the substantially horizontal part of the chair upon which a user actually sits.

BACKGROUND OF THE INVENTION

For many years chairs have been manufactured such that the seat or the back of the chair is made of an injection moulded plastics material.

Conventionally, in order to give these materials sufficient strength for relatively rugged use, there was provided a peripheral metal frame to which the seat or back could be connected. In this way, the chairs made were quite utilitarian but they remained somewhat expensive to manufacture and necessitated substantial assembly.

More recently it has been known to manufacture chair seats or backs from an unreinforced plastics material, with a plurality of ribs extending generally parallel to the centre line of the chair across a substantial portion of the depth or height of the seat or back, in order to provide the required strength.

These components, whilst having sufficient physical strength, are generally not very aesthetically pleasing and are often difficult and tiresome to clean and maintain.

It will be appreciated, that not only in outdoor chairs, but in those which are used commercially, there can often be a build up of dust and dirt. In order to clean the abovementioned types of chair it would be necessary for a cleaner to physically pass a cleaning cloth or the like along the length of each of the grooves.

Manufacturing of these chairs has also proved to be difficult, particularly in the moulding of the seat or back, as there are a number of relatively narrow ribs which need to be filled by the material being passed into the die during production.

It is common practice for chairs to be fitted with pivotal connections which are attached to the seats. The pivotal connection usually has a bias means so that when the seat is not being used it adopts a position directed generally upwardly so that no part of the seat extends substantially forward and, particularly with seats with arms, no part extends beyond the extension of the arms. This provides maximum space allowance for a person who is passing through an aisle of such seats. The bias usually takes the form of a counterweight which is generally connected to the rear of the seat on its underside.

Previous proposals have attempted to provide various modes of enabling movement of the seat about its pivot, and means of controlling such movement, however, these have been quite complex and necessitated substantial assembly operations.

Furthermore there have been provided various methods of connecting chairs to surfaces, say in stadium seating where there are a number of chairs connected to the concrete risers or the treads of the stadium arrangement, and it is desirable to permit this connection to be as simple and rapid as possible not only for initial setting up of the stadium, but also if there are damaged chairs which need to be removed so that they can be removed quickly and efficiently.

At the same time, the connection has to be sufficiently stable for a user to use the chair even under conditions of substantial excitement and without allowing a chair to be readily removed from the connection, as a chair so removed, can be used a weapon if there is any riotous behaviour.

OUTLINE OF THE INVENTION

It is an object of the present invention to overcome or substantially ameliorate the disadvantages of the prior art by providing a chair in which the seat and/or back is made of a moulded plastics material not requiring additional reinforcement, whereby the seat component is counterbalanced so as to enable rotation about a pivot point.

It is a further object of the invention to provide a method of locating a chair seat for rotation so that the rotation is controlled and yet the components and assembly of the seat are minimal.

It is a further object of the invention to provide a counterbalance which is located within the confines of the seat so that it cannot be readily removed.

It is yet another object of the invention to provide an improved method of connecting a seat to a member.

In a first aspect of the invention we provide a chair seat and/or a back member where, during moulding at the sides of the member, there is at least one removable core which extends into the body so that the extrusion of plastics material occurs between the core and a female part of the die so the formation of a chair has an insert void surrounded, or substantially surrounded by the plastics material, having been moulded to impart substantial rigidity to the chair seat or back member.

It is preferred that when forming a seat using such cores, the cores adjacent the rear of the seat are extended so that, the cores from each side effectively terminate in contact or near contact in the middle of the seat, providing a continuous compartment passing through the seat from each side thereof when the seat is moulded.

In a second aspect of the invention we provide a pivot assembly for a chair seat which includes an aperture on an arm or frame of the chair, a pivot member associated with the chair seat and adapted to be received onto the aperture, and a bearing member which acts as a bearing for the rotation and also as a buffer at the extremes of the rotation whilst ultimately retaining the assembly together.

It is preferred that the apertured portion on the seat frame or arm may have provided, a plurality of substantially segmented portions extending inwardly, adapted to receive the outwardly extending portions of the pivot member, whereby the two sets of portions are complimentary, to enable rotation between a first position at which the seat is in a useable condition, to a second position where the seat is substantially upwardly directed.

It is preferred that the bearing member of the pivot mechanism have a plurality of outwardly directed radial springs associated with each pair of likely abutting segmented portions, whereby the springs act as a buffers at the end of the movement in each direction.

It is further preferred that the bearing member can also have clips or the like on its outer ends which can be adapted to pass through corresponding apertures and into the area surrounding the receiving aperture on the frame or the arms of the chair, so that when the chair is assembled these act to prevent ready removal of the chair components.

In a third aspect of the invention we provide a means whereby chairs can readily be connected to a surface such as a beam, a riser or a tread which includes an extrusion upwardly directed connected to the fixed surface and an extension from the back of the chair which is formed to enter a hollow centre of the extrusion and to be located thereon and having means whereby the member can be locked onto the extrusion.

It is preferred that there also be some alternative means which prevent ready removal of the chair from the extrusion unless a detent or the like is operated so that, even if some person released the lock, the chair would still not be free to be removed from the extrusion.

In order that the invention be more readily understood we will describe by way of non limiting example a specific embodiment thereof.

BRIEF DESCRIPTION OF THE DRAWING FIGURES

Figure 1:
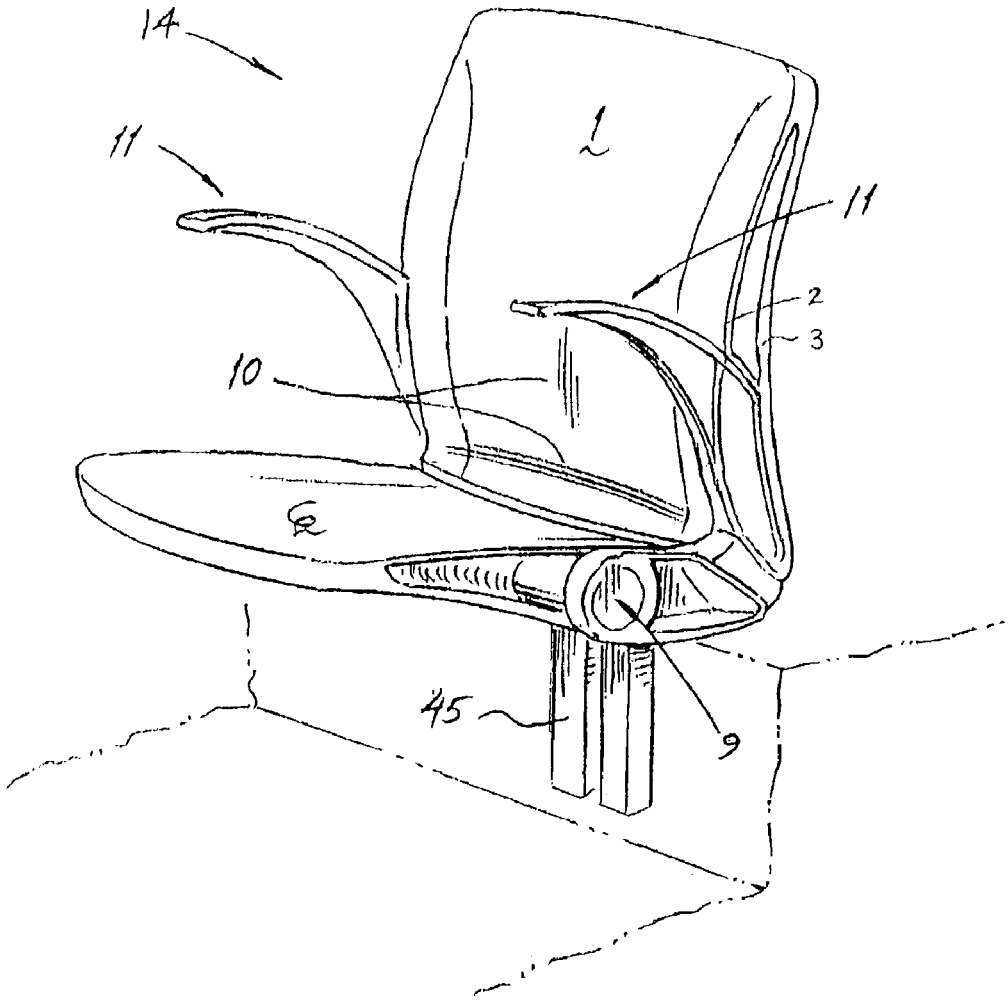
FIG. 1 is a front perspective view of the chair according to the invention.
Figure 2:
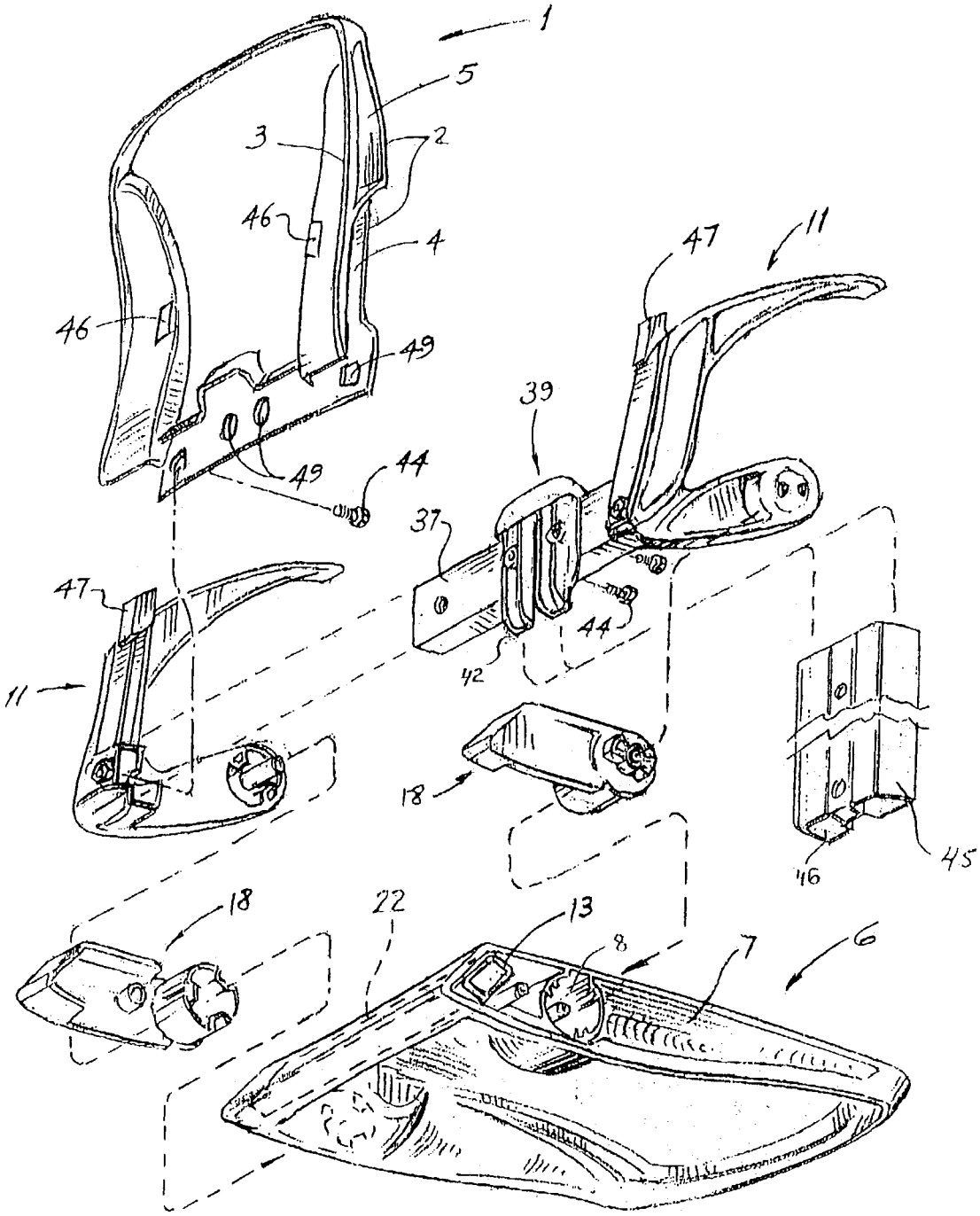
FIG. 2 is a rear underneath perspective view of the chair with the subassemblies shown partly exploded.
Figure 3B:
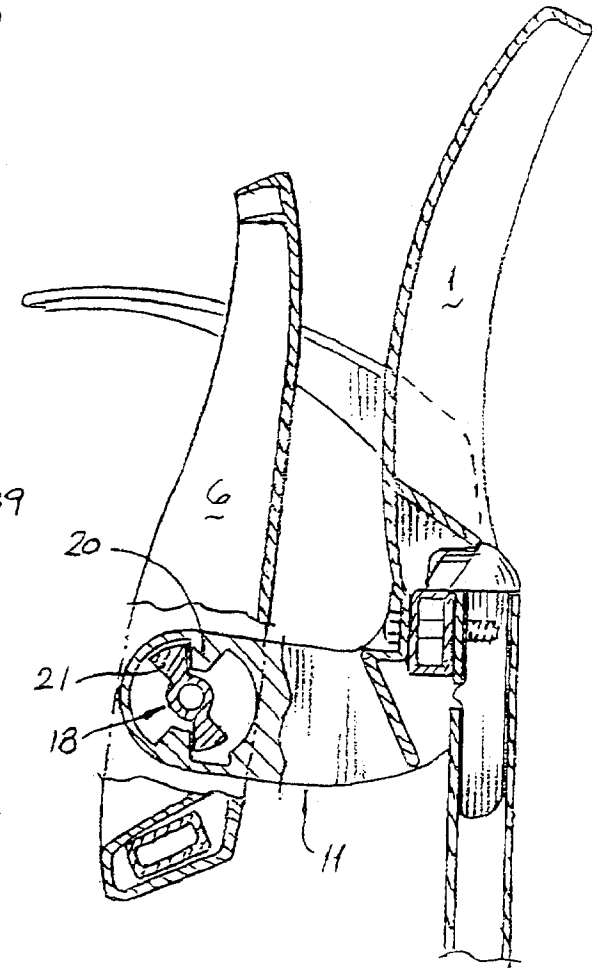
Figure 3A:
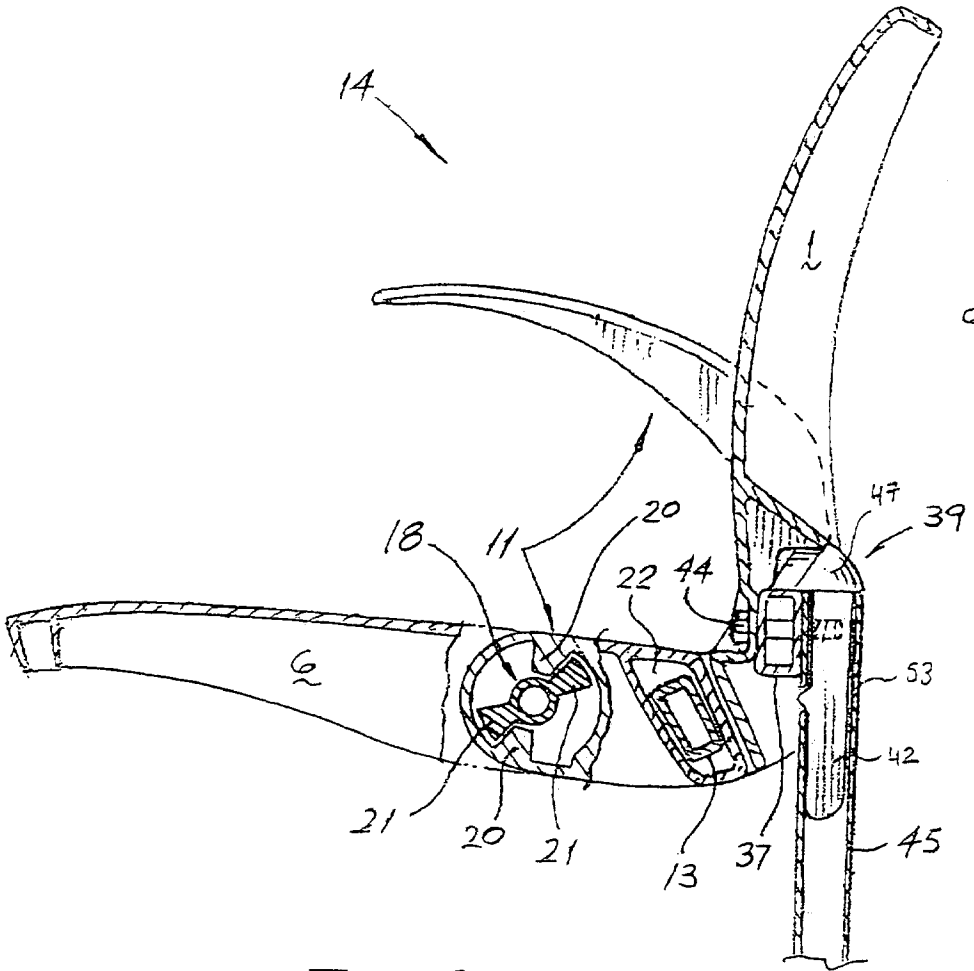
Figure 4:
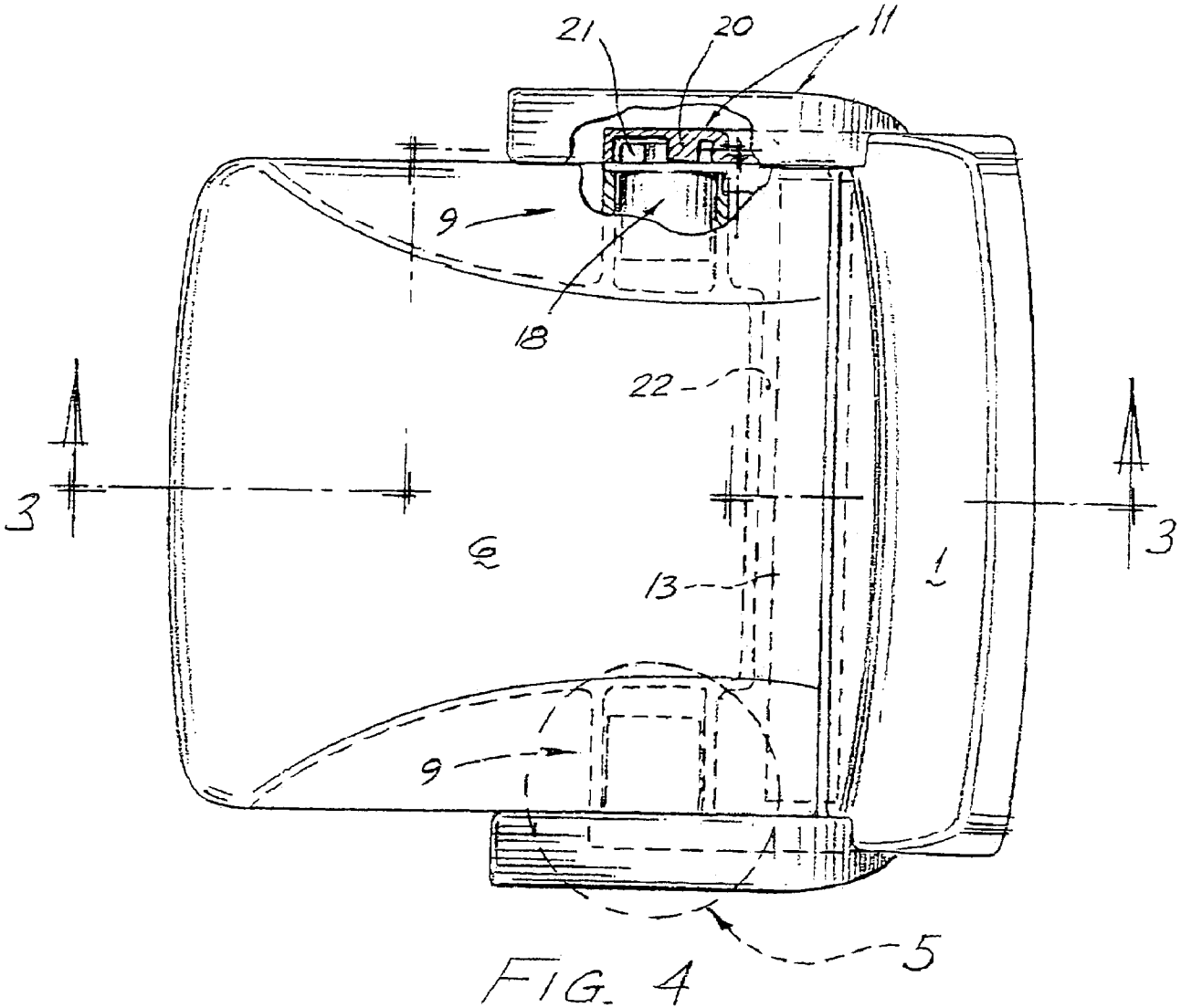

FIG. 3*a* is a side view of the chair taken along line 3—3 of FIG. 4 showing the seat member in a normal use position.

FIG. 3*b* is a side view of the chair taken along line 3—3 of FIG. 4 showing the seat member in an initial upright position.

FIG. 4 is a plan view of the chair.

Figures 5A, 5B:
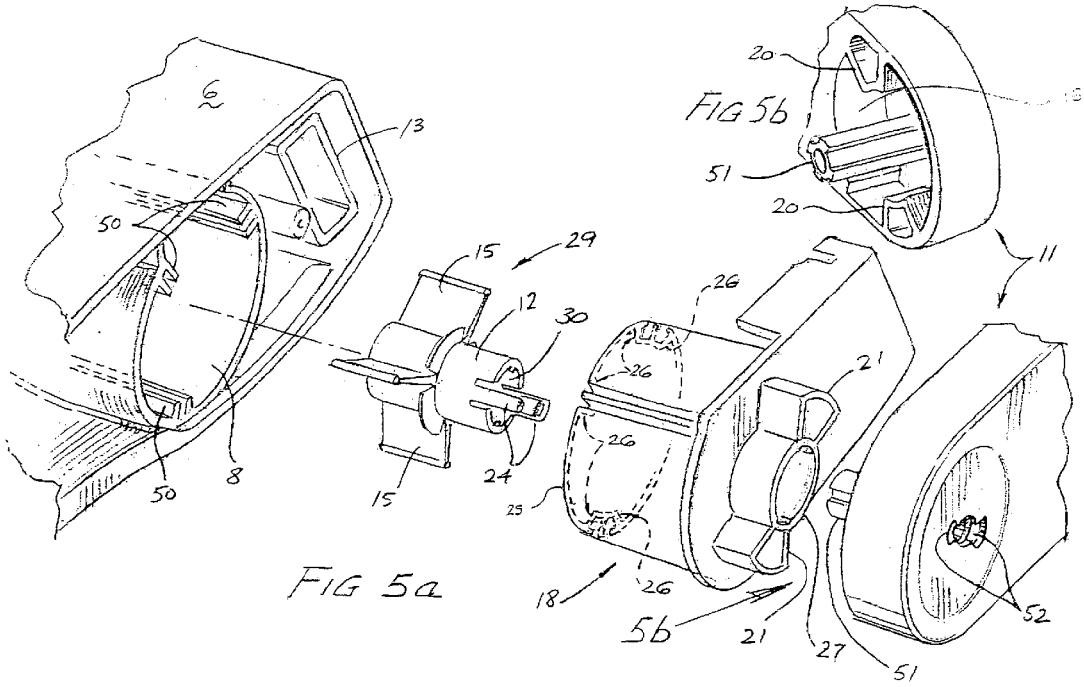

FIG. 5*a* is an exploded view of the pivot mechanism of the chair.

FIG. 5*b* is a perspective view taken along the arrow 5*b*.

Figure 6A:
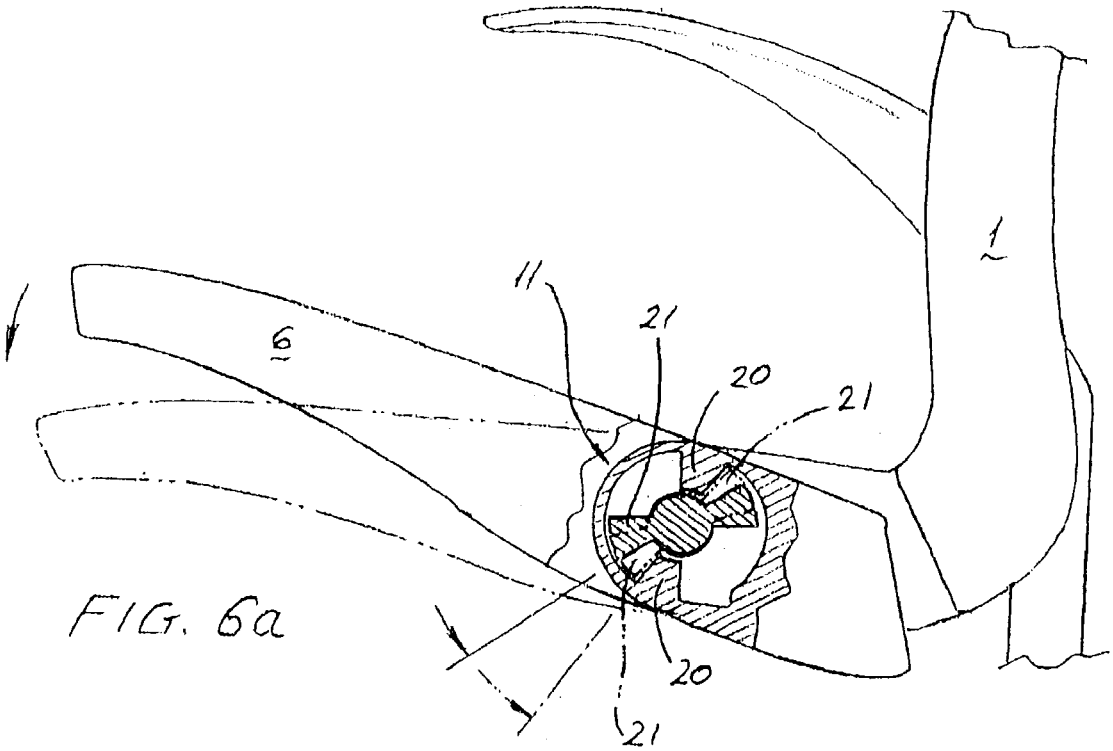

FIG. 6*a* is a side schematic view, a partial in section, of the pivot mechanism showing the further degree of movement of the pivot member which can be achieved when the seat member is in the normal use position.

Figure 6B:
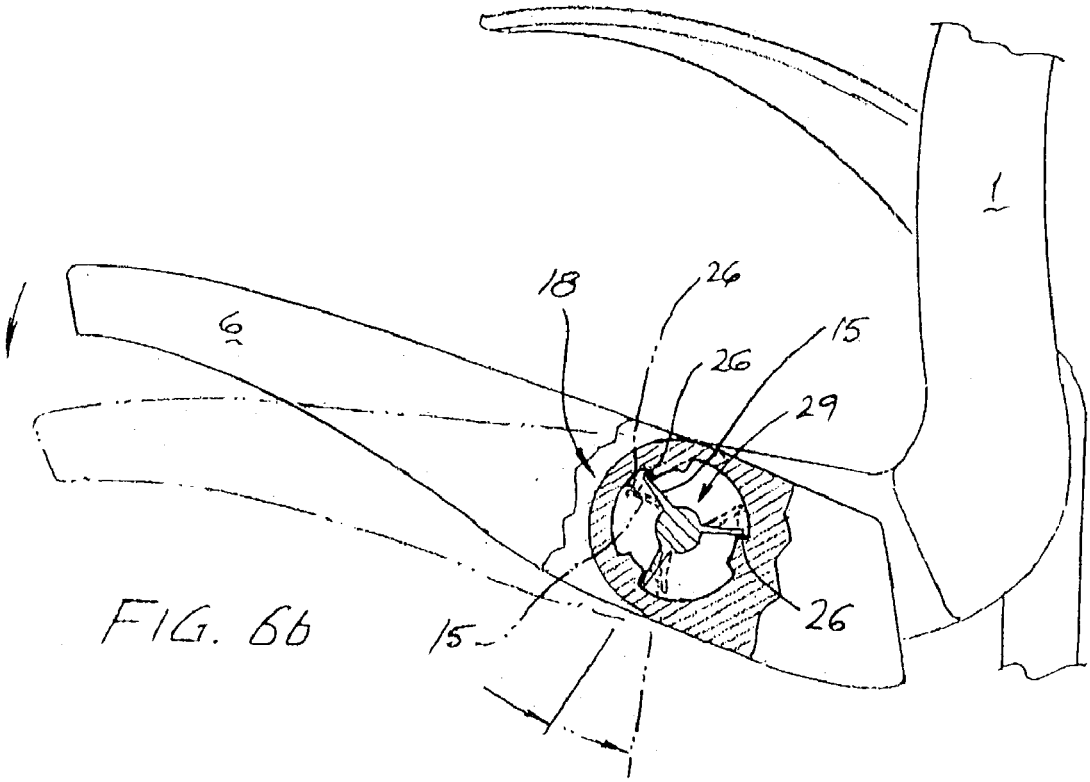

FIG. 6*b* is a side schematic view, a partial in section, of the pivot mechanism showing the further degree of movement of the spring members which can be achieved when the seat member is in the normal use position.

Figure 7A:
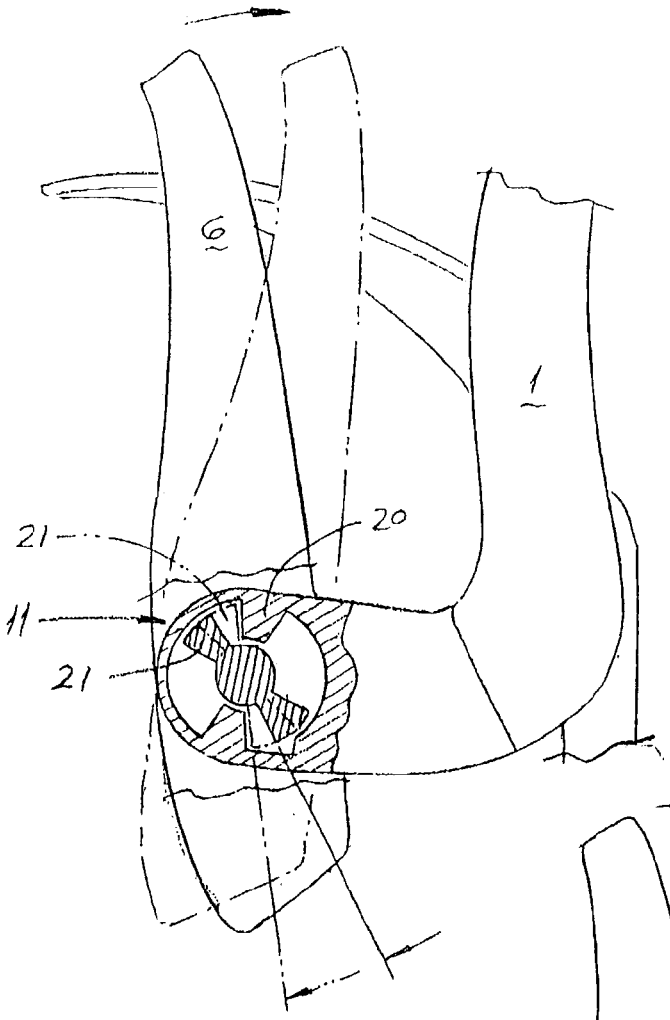

FIG. 7*a* is a side schematic view, a partial in section, of the pivot mechanism showing the further degree of movement of the pivot member which can be achieved when the seat member is in the initial upright position.

Figure 7B:
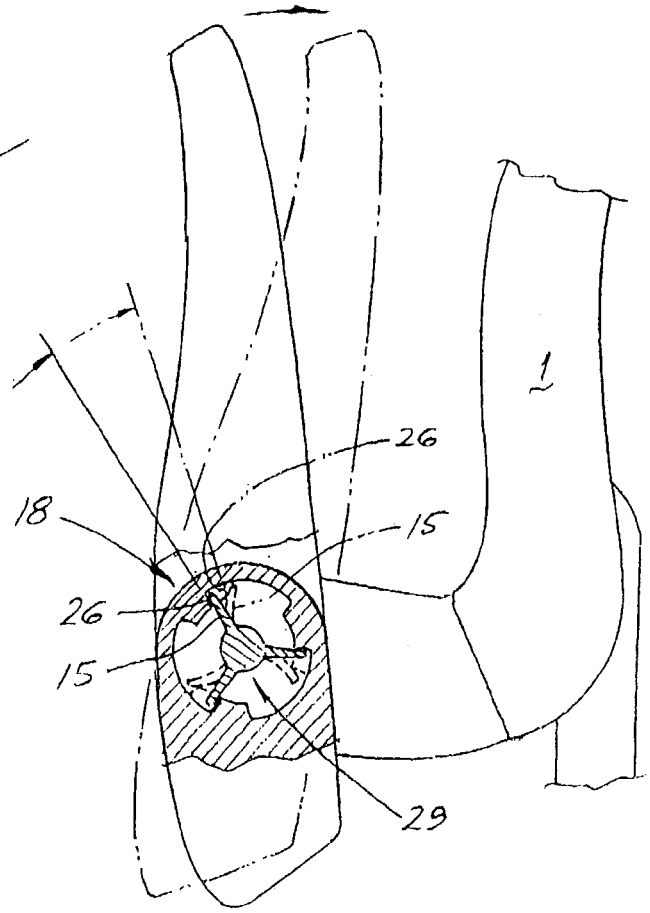

FIG. 7*b* is a side schematic view, a partial in section, of the pivot mechanism showing the further degree of movement of the spring members which can be achieved when the seat member is in the initial upright position.

FORMATION OF THE CHAIR SEAT AND BACK

During moulding of the chair 14, there are removable cores (not shown), located along each side in the mould (not shown), which may extend into the body of the back member 1 and the seat member 6 when the chair 14 is formed so that, extrusion of plastics material occurs between the back core recess 5 and seat core recess 7 and the female part of the die so the formation of the chair has an insert void surrounded, or substantially surrounded by the plastics material having been moulded to impart substantial rigidity to the chair seat or back.

When forming the seat member 6 using such removable cores (not shown), the cores adjacent the rear of the seat member 6 are extended so that, the cores from each side effectively terminate in contact or near contact in the middle of the seat member 6, providing a continuous compartment 22 passing through the seat member 6 from each side thereof when the seat member 6 is moulded.

The back member 1 is injection moulded from a satisfactory engineering grade plastics material. Both the front face 2 and back face 3 of the back member may be forwardly directed to provide a curved portion 10 in the lower part thereof, providing an ergonomic lumbar support to be comfortable for a wide range of users.

Provided on each side of the back member 1 is a back core recess 5 which is positioned so that it lies between the front face 2 and the back face 3 of the back member 1, whereby the material of both the front 2 and back 3 face form its periphery. These back core recesses 5 provide the back member 1 with a high degree of internal rigidity to give added strength to the chair. The lower portion 4 of the back core recess 5 is adapted such that it is able to receive part of the frame, which includes a pair of side supports, each of which is referred to herein as armrest construction 11. In order to ensure that the armrest construction 11 remains secure to the back member 1, apertures 46 are provided on the back face of the back core recess 5 which are adapted to receive extensions 47 on the upwardly directed portion of the armrest construction 11.

The back core recess 5 may be curved so that the thickness of the material on each adjacent face 2, 3 surrounding the back core recess 5 is substantially constant. The top of the back core recess 5 may be curved to obtain an aesthetically pleasing look, whilst also maintaining the added strength which is achieved by such a formation of having effectively parallel parts of plastics material being spaced by the thickness of the back core recess 5.

Provided along the base portion of the back member 1 are a plurality of circular holes 49 in order to receive bolts 44 which secures the bar 37, located therebehind, to the back member 1, and the armrest construction 11 either end of the bar 37.

The design of the back member 1 enables it to be self sustaining without the requirement for any further reinforcement such as ribbed reinforcement. Lack of any ribbed enforcement ensures the chair 14 is much more simplistic to clean should it be necessary to do so.

The seat member 6 is manufactured in a similar way to the back member 1 and is provided with a similar seat core recess 7 formed by the removable core members (not shown) of the mould which extend into the die from each side. Provided within the seat core recess 7 located towards the rear of each side of the seat, is an injected circular recess 8 which is adapted to receive the pivot member 18 of the pivot mechanism 9. The injected circular recess 8 has 3 sets of linear extensions 50 which protrude toward the centre of the recess 8. These extensions 50 are adapted to slide into the complimentary configuration provided on the outer surface of the three inwardly directed indentations 26 of the pivot member 18.

Extending across the width of the seat adjacent to its rear, is a continuous compartment 22 which is formed by removable core members (not shown) on the mould that pass through half of the width of the seat member 6 on either side and terminate in contact or near contact in the middle of the seat member 6, so that when the seat member 6 is moulded, there is a continuous compartment 22 spanning the full width of the seat 6.

The continuous compartment 22 is adapted to receive the counterweight 13 for the seat, with the ends of the continuous compartment 22 adapted to be enclosed by the pivot member 18 so that, the counterweight 13 is fully enclosed within the compartment 22 and cannot be separated from the seat member 6.

Complete encasing of the counterweight 13, allows an observer to only see the walls of the compartment 22 in which the counterweight 13 is received when the seat 6 is in its raised position, an advantage which adds to the aesthetic appeal of the chair.

The Pivot Mechanism

The pivot mechanism 9 for a chair seat member 6 is ultimately a combination of three components. It includes the armrest component 11 having an aperture 16, which also basically forms part of the frame of the device and provides the connection of the back member 1 to the assembly, a pivot cup a pivot member 18 which is associated with the chair seat member 6 and adapted to be received onto the aperture 16 and a spring body, referred to herein also as bearing member 29, which acts both as a bearing for the rotation of the pivot member 18, and as a buffer at the extremes of the rotation in order to retain the assembly together.

The aperture 16 portion on the armrest construction 11 may have a plurality of substantially segmented inwardly extending portions 20 associated with the pivot member 18. There can also be a plurality of segmented outwardly extending portions 21 provided on the pivot member 18, with the two sets of portions 20 and 21, being complimentary to enable rotation between a first position at which the seat 6 is substantially upwardly directed, lying within a vertical place adjacent to the back member 1 (see FIG. 3*b*), to a second position where the seat is in a useable condition (see FIG. 3*a*). Thus, these portions 20, 21 also act as stops for each position. Extending outwardly from the aperture 16 is a circular extension 51 adapted to receive the tapered pivot bush 12 of the bearing member 29 which secures the pivot mechanism 9 with clips 24 which engage with two holes 52 provided on opposite sides of the circular extension 51.

The pivot member 18 can be provided with an inwardly directed annular skirt 25 defining a cavity having three spaced inwardly directed indentations 26 which, in plan, have tapered sides. The pivot member 18 may also have provided an outwardly directed annular member 27 positioned in its centre adapted to receive the tapered pivot bush 12 of the bearing member 29.

The bearing member 29 may be made of a low friction material, such as nylon, and has a central hollow cylindrical portion 30 which is adapted to be located over the circular extension 51 of the aperture 16. In the embodiment clearly illustrated in FIG. 5*a*, it can be seen that the central hollow cylindrical portion 30 of the spring body or bearing member 29 and the extension 51 of the side support or armrest 11 are preferably configured with mateable splines. The bearing member 29 has three radial spring members 15 which are in the form of flat blades extending equidistantly outwardly therefrom each being received in one of the spaces between each adjacent pair of inwardly directed indentations 26 previously described. The spring members 15 act as a buffer at the end of the rotational movement in each direction.

When the components are assembled, tapered pivot bush 12 passes through the annular member 27 of the pivot member and is secured to the armrest construction 11 by locating the tapered pivot bush 12 over the circular extension 51 and pressing down until the clips 24 pass through the holes 52 and engage with the outer edge of the circular extension 51 to secure the components 29, 11, 18 together. The seat member 6 is the attached to the armrest construction 11 by aligning the linear extensions 50 in the circular recess 8 of the seat member 6 with the complimentary configuration provided on the outer surface of the three inwardly directed indentations 26 of the pivot member, and locating the seat onto the pivot member 18, connecting the seat member 6 to the armrest construction 11.

The rest position is where the counterweight 13 causes the seat member 6 to extend upwardly to effectively clear the aisle so that persons can readily walk therethrough. The normal use position is where a person is sitting on the seat member 6, where the person's weight overcomes the counterweight 13 and the seat member 6 is lying in a substantially horizontal plane.

As far as the seat member 6 adopting its initial position is concerned, it is in fact the spring members 15 extending outwardly from the bearing member which strike the inwardly directed indentations 26 in the annular skirt 25 and locate the seat member 6 in its upright position.

As the spring members 15 are at an angle to the adjacent indentations 26 on the pivot member 18, there can, in fact, be another degree of movement against the spring members 15 if the seat member 6 is physically rotated somewhat further.

This may be a movement of approximately 15° so that, should a user of the chair 14 wish to permit another patron to pass, they can put pressure onto the seat member 6 which will move back to the further position and, when this pressure is removed, the spring members 15 will return the seat member 6 to its normal rest position and when the person sits on the seat member 6 then it will adopt the normal use position.

The arm rest construction 11, can be made of engineering grade plastics materials and, as described above, once the bearing member 29 is located and clipped to the seat assembly 6 then the arrangement is complete.

It can thus be seen that there is provided a neat and practical bearing arrangement where the buffers to extreme movements of the seat 6 are provided by the outwardly directed spring members 15 which also provide a further degree of movement of the seat 6 from its normal upward position.

Connection Means

The connection means 39 is adapted to be received in an aluminium extrusion 45 or the like which can be directly connected to the riser of the stadium stairs, and can be connected to a bar 37 which extends relative to the stadium floor or could be connected to a member on the flat portion of the stadium floor.

The connection means can have a pair of downwardly extending spaced members 42 which can be tapered at their lower ends and can be provided with recesses, whereby bolts 44 can pass therethrough into the bar which connects the two arm constructions 11, and can be connected by way of being threaded into this bar 37 or to nuts 43 located therebehind.

The arrangement is such that these members 42 stand somewhat proud of the bar 37 and spacers can be provided by way of extensions about the positions of connection.

It is preferred that the extrusion 45 has cutouts 46 adapted so that it can receive the members 42 of the connection means 39, and the upper portion of the connection means 39 may be provided with a curved head 47 which may extend beyond the downwardly directed spaced members 42 by approximately the thickness of the extrusion 45.

We can also provide a downwardly directed member from the underside of the head which is adapted to be received in a portion of the complimentary extrusion.

The arrangement is such that the chair 14 would normally be provided with the connection means 39 being loosely connected to the bar 37 so that the chair 14 can simply be located over the extrusion 45 and moved into contact therewith so that it is received within the extrusion 45 and moved downwardly until the upper part of the extrusion comes into contact with the extended portion of the head 47 of the connection means 39.

It is only necessary then to tighten the bolts 44 so that there is a clamping action between the bar 37 which extends across the back of the chair 14 and the connection means 39 against one surface of the extrusion 45.

It may be preferred that the downwardly directed spaced members 42 has a protuberance 53 which can, when the chair 14 is properly seated, enter into an aperture or the like in the extrusion 45 so that, when the chair 14 is not held fixed by the bolts 44, there is a resistance to upward movement unless the protuberance 53 is forced into the extrusion 45 to free the connection means 39 relative thereto.

The arrangement of this can be such that we provide a special tool which can move the protuberances 53 inwardly to free them from the apertures to permit the chair 14 to be readily removed.

This means that even if the connection bolts 44 are loosened or removed, there will be a resistance to the removal of the chair 14. This can restrict stealing of chairs or the use of chairs as weapons.

Whilst we have described, in the embodiment, a chair which has a pivotally mounted seat it will be appreciated that the invention, as far as the formation of the seat and back are concerned, can equally well be applied to a fixed seat and the invention, as far as the connector means is concerned, could be used with seats of various configurations and is not restricted to use with a seat exactly as described.

Thus it can be seen that various variations and modifications can be made in the seat of the invention without departing from the spirit and scope of the invention.

What is claimed is:

1. A chair or seat having a back member, a seat member, a frame, and a pivot assembly operable to pivotally mount the seat member relative to the frame, the pivot assembly comprising: an extension projecting from the frame of the chair; a pivot member fixed to the seat member, the pivot member including a skirt portion and a central annular member; and a bearing member including a pivot bush that extends through an interior of said annular member, the pivot bush having a central hollow portion that receives said extension, wherein the pivot bush is secured relative to the frame and includes least one radially extending spring member to act against the skirt portion as a buffer at extremes of rotation of the seat member.

2. The chair or seat as claimed in claim 1 wherein the frame of the chair includes an aperture, the extension projecting from a location within the aperture, wherein the frame includes a plurality of segmented portions extending inwardly within the aperture.

3. The chair or seat as claimed in claim 2 wherein the aperture includes an at least one hole adjacent a perimeter of the extension to receive a portion of the bearing member.

4. The chair seat as claimed in claim 2 wherein the pivot member includes a plurality of outwardly extending portions complimentary to the inwardly extending portions of the aperture such that the seat member can rotate between a first and second position as limited by contact between the outwardly extending portions and the inwardly extending portions.

5. The chair or seat as claimed in claim 1 wherein the skirt includes a plurality of inwardly directed indentations.

6. The chair or seat as claimed in claim 5 wherein the bearing member includes multiple spring members and wherein each of the spring members is a blade, and each of the blades is adapted to be located between each pair of adjacent indentations to act as a buffer at an end of the rotational movement in each direction.

7. The chair or seat as claimed in claim 1 wherein the aperture includes at least one hole adjacent a perimeter of the extension, and wherein the bush has at least one clip adapted to engage with the or each hole adjacent the perimeter of the circular extension, providing a means for the connecting the pivot assembly together.

8. The chair or seat as claimed in claim 1 having a counterbalance to enable rotation about a pivot point, whereby the rotational movement is controlled.

9. The chair or seat as claimed in claim 8 wherein the counterbalance is a counterweight positioned adjacent the rear of the seat to enable rotation about a pivot point, located within the confines of the seat so that it cannot be readily removed.

10. The chair or seat as claimed in claim 1 wherein the back member and seat member are injection moulded and are provided with core recesses along each side to impart substantial rigidity to the members.

11. The chair or seat as claimed in claim 10 wherein a lower portion of the back member is curved to provide an ergonomic lumbar support for comfort to users.

12. The chair or seat as claimed in claim 1 having a connection means adapted to be located with an aluminium extrusion connected to a riser of a stadium stair.

13. The chair or seat as claimed in claim 12 wherein the connection means is connected to a bar adapted to connect the back member and frame together.

14. The chair or seat as claimed in claim 1 wherein the bearing member is tapered.

15. A seat comprising:

a pair of side supports;

a pivotal seat member; and a pair of pivot assemblies operable to pivotally mount the seat member relative to the frame generally between the side supports, each of the pivot assemblies including:

a pivot member connected to the seat member, the pivot member including a skirt portion defining a cavity with a plurality of inwardly directed indentations; and a spring body disposed in the cavity, the spring body having a central bush that is secured relative to a respective one of the side supports, the spring body including a plurality of spring members, each spring member extending radially from the central bush, wherein the spring members act against the inwardly directed indentations to rotationally bias the pivot member through at least a degree of motion of the seat member.

16. The seat of claim 15, wherein spring members are blade-shaped, and wherein said indentations and said spring members are angularly oriented such that the spring members are free of contact with the indentations through a degree of pivotal movement of the seat member.

17. The seat of claim 16, wherein the spring body includes three of the spring members and wherein the pivot member includes three of the indentations.

18. The seat of claim 15, wherein said pivot members enable said seat member to pivot between a normal use position for supporting a user and an upright position, and wherein said spring body and said indentations bias the seat member toward the upright position when the seat member is pivoted beyond an initial upright position located between the normal use position and the upright position.

19. The seat of claim 15, wherein the seat member can pivot move about 15° between the initial upright position and the upright position.

20. The seat of claim 15, wherein said pivot members enable said seat member to pivot between a normal use position for supporting a user and an upright position, and wherein said spring body and said indentations are configured to bias the seat member toward the upright position when the seat member is near the normal use position; and wherein, and wherein said spring body and said indentations are further configured to bias the seat member toward the upright position when the seat member is pivoted beyond an initial upright position located between the normal use position and the upright position.

21. The seat of claim 15, wherein the pivot member further comprises a central annular member, and wherein the pivot central extends through an interior of said central annular member, the central bush having a central hollow portion that receives said extension.

22. The seat of claim 21, wherein the central bush and the extension of the side support include mateable splines.

23. The seat of claim 20, wherein the spring body includes at least one clip extending from the central bush, each of the clips being configured to engage a corresponding hole in a respective one of the side supports to secure the spring body relative to the side support.

24. The seat of claim 15, wherein said pivot members enable said seat member to pivot between a normal use position for supporting a user and an upright position, and wherein said spring body and said indentations bias the seat member toward the upright position when the seat member is near the normal use position.

* * * * *